US007946577B2

(12) United States Patent
Asari et al.

(10) Patent No.: US 7,946,577 B2
(45) Date of Patent: May 24, 2011

(54) SWITCHBACK MECHANISM, SWITCHBACK APPARATUS, AND SWITCHBACK METHOD

(75) Inventors: Yukio Asari, Yokohama (JP); Yoshihiko Naruoka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1048 days.

(21) Appl. No.: 11/716,703

(22) Filed: Mar. 12, 2007

(65) Prior Publication Data

US 2007/0216085 A1 Sep. 20, 2007

(30) Foreign Application Priority Data

Mar. 17, 2006 (JP) ..... 2006-075106

(51) Int. Cl.
*B65H 29/00* (2006.01)

(52) U.S. Cl. ..... 271/186; 271/65

(58) Field of Classification Search ..... 271/65, 271/186, 902, 184, 185, 3.14, 291, 225
See application file for complete search history.

(56) References Cited

U.S. PATENT DOCUMENTS

| | | | | |
|---|---|---|---|---|
| 4,486,012 | A * | 12/1984 | Bock et al. | 271/3.15 |
| 2002/0070497 | A1 * | 6/2002 | Morrison et al. | 271/186 |
| 2003/0057636 | A1 * | 3/2003 | Ina et al. | 271/186 |
| 2006/0214362 | A1 | 9/2006 | Matsumoto et al. | |
| 2007/0040325 | A1 | 2/2007 | Matsumoto et al. | |

FOREIGN PATENT DOCUMENTS

| | | | |
|---|---|---|---|
| EP | 1295826 | A2 | 3/2003 |
| EP | 1424299 | A2 | 6/2004 |
| EP | 1544145 | A1 | 6/2005 |
| JP | 05-330714 | | 12/1993 |
| JP | 06-329321 | | 11/1994 |
| JP | 2004-175507 | | 6/2004 |
| JP | 2005-082394 | | 3/2005 |
| JP | 2005-138959 | | 6/2005 |
| JP | 2005-178945 | | 7/2005 |
| KR | 10-0525536 | | 11/2005 |

OTHER PUBLICATIONS

European Search Report dated May 14, 2009 for App. 07004238.7-1256/1834910.
Korean Office Action dated Jun. 11, 2008 for Appln. No. 10-2007-0025376.
Japanese Office Action dated Jul. 13, 2010.

* cited by examiner

*Primary Examiner* — Stefanos Karmis
*Assistant Examiner* — Thomas A Morrison
(74) *Attorney, Agent, or Firm* — Pillsbury Winthrop Shaw Pittman, LLP

(57) ABSTRACT

A switchback mechanism for reversing a mail item conveying direction has a switchback roller which holds the mail item in a nip and rotates in both forward and backward directions. When there is a remaining mail item deviated from the nip of the switchback roller and remaining in the switchback unit, a pressure roller is pressed to an output roller always rotating in the direction of R1, the remaining mail item is held and fed out to the nip. At this time, a control unit takes out the remaining mail item at timing not to interfere with other mail items.

5 Claims, 13 Drawing Sheets

SWITCHBACK MECHANISM, SWITCHBACK APPARATUS, AND SWITCHBACK METHOD

CROSS-REFERENCE TO RELATED APPLICATIONS

This application is based upon and claims the benefit of priority from prior Japanese Patent Application No. 2006-075106, filed Mar. 17, 2006, the entire contents of which are incorporated herein by reference.

BACKGROUND OF THE INVENTION

1. Field of the Invention

The present invention relates to a switchback mechanism to reverse a paper sheet conveying direction, a switchback apparatus provided with at least one switchback mechanism and a bypass conveying path to bypass the switchback mechanism, and a switchback method.

2. Description of the Related Art

There is a conventional switchback apparatus, which accepts a paper sheet conveyed in a first direction in a nip of a switchback roller rotating in a first direction, feeds the sheet in the first direction, stops once while holding the sheet in the nip, and reverses the sheet conveying direction by rotating the switchback roller in a second direction opposite to the first direction (refer to JP-A 2004-175507 (KOKAI).

As illustrated in FIG. 14, this conventional switchback apparatus has an area 200 not tightly holding a sheet M in the downstream of a nip N along a first direction (left to right in the drawing). Usually, the length of this area 200 is designed shorter than a shortest sheet among sheets M to be handled (hereinafter, such a sheet is called a shortest sheet $M_{min}$). Namely, the length of the area 200 is designed so that the sheets M of all lengths fed to a switchback apparatus do not come out of the nip and drop into the apparatus.

However, in an actual operation, a sheet M may be creased or torn on the way of conveying, and become shorter than an assumed shortest sheet $M_{min}$. Even if such a sheet M becoming short undesirably is conveyed to a switchback apparatus, the sheet can be rejected without being input to a switchback apparatus, when the existence of that sheet M can be detected before it is fed to the switchback apparatus. But, if a short sheet M overlaps with a normal sheet M and fed to a switchback apparatus together with the normal sheet M, the short sheet M may remain in the area 200 not having a feeding force in a switchback apparatus, after the normal sheet M is output from a switchback apparatus.

If a normal-length sheet M is fed to a switchback apparatus while a short sheet M undesirably remains in the area 200 (hereinafter, such a sheet remaining in an area not having a tight-holding force is called a remaining sheet $M_r$), the sheet M abuts the sheet $M_r$, and the sheets may be creased and are very likely to cause a paper jam. In this case, the remaining sheet $M_r$ and normal sheet M fed after may tear. When a paper jam occurs in a switchback apparatus, it is necessary to stop the apparatus and clear the jam. This reduces the throughput of the apparatus.

Moreover, if such a torn sheet M is fed out from a switchback apparatus, the sheet may interfere with other normally-handled sheets M and cause secondary trouble. For example, a remaining sheet $M_r$ output from a switchback unit at an uncontrollable timing overlaps with a normally-handled sheet M at a joint point after passing along another path, and causes another paper jam. Namely, if a remaining sheet $M_r$ remaining in a switchback apparatus is output from the switchback apparatus at an unexpected timing, it causes another paper jam, and requires stopping the apparatus to clear the jam, decreasing the throughput of the apparatus.

BRIEF SUMMARY OF THE INVENTION

It is an object of the invention to provide a switchback mechanism, switchback apparatus and a switchback method, which detect and automatically reject a remaining sheet remaining in a switchback unit at an appropriate timing, greatly decrease the number of times to stop the apparatus for clearing a paper jam, and increase the throughput of the apparatus.

In order to achieve the above object, a switchback mechanism according to an embodiment of the invention has a switchback roller which accepts in a nip a sheet conveyed in a first direction toward a switchback unit, rotates in the first direction, stops the paper sheet in the switchback unit while holding the sheet in the nip, rotates in a second direction reverse to the first direction, reverses the sheet conveying direction, and takes out the sheet from the switchback unit to the second direction; a remaining sheet sensor which detects a remaining sheet deviated from the nip in the downstream of the nip along the first direction and remaining in the switchback unit; an output mechanism which takes out the remaining sheet from the switchback unit; and a control unit which takes out the remaining sheet from the switchback unit by operating the output mechanism, when the remaining sheet is detected through the remaining sheet sensor, after the switchback roller finishes the switchback operation.

A switchback apparatus according to an embodiment of the invention has at least one switchback mechanism which accepts a sheet conveyed in a first direction in a switchback unit, reverses the sheet conveying direction, and feeds out the sheet to a second direction; and a bypass conveying path which conveys a sheet bypassing the switchback mechanism; wherein the switchback mechanism has a switchback roller which accepts in a nip a sheet conveyed in the first direction toward a switchback unit, rotates in the first direction, stops the paper sheet in the switchback unit while holding the sheet in the nip, rotates in a second direction reverse to the first direction, reverses the sheet conveying direction, and takes out the sheet from the switchback unit to the second direction; a remaining sheet sensor which detects a sheet deviated from the nip in the downstream of the nip along the first direction and remaining in the switchback unit; an output mechanism which takes out the remaining sheet from the switchback unit; and a control unit which takes out the remaining sheet from the switchback unit by operating the output mechanism, when the remaining sheet is detected through the remaining sheet sensor after the switchback roller finishes the switchback operation.

A switchback method according to an embodiment of the invention has a switchback step of accepting a sheet conveyed in a first direction in a nip of a switchback roller rotating in the first direction, taking the sheet into a switchback unit, rotating the switchback roller in a second direction reverse to the first direction, reversing the sheet conveying direction, and outputting the sheet from the switchback unit to the second direction; a detection step of detecting existence of a remaining sheet deviated from a nip in the downstream of the nip along the first direction and remaining in the switchback unit, after the switchback step is finished; and a rejection step of rejecting the remaining sheet from the switchback unit, when the remaining sheet is detected in the detection step.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the invention will be explained in detail hereinafter with reference to the accompanying drawings.

Figure 1:
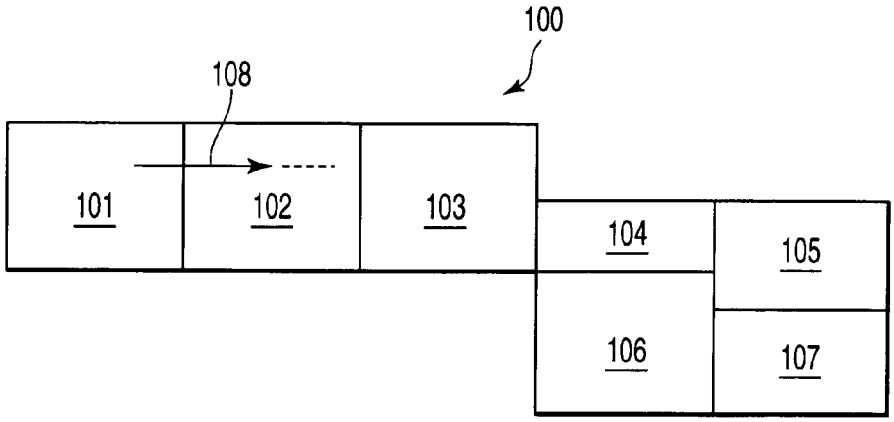
FIG. 1 is a block diagram of a stamping apparatus having a switchback apparatus according to an embodiment of the invention.

FIG. 1 diagrammatically shows a mail sorting/adjusting stamping apparatus 100 (hereinafter simply called a stamping apparatus 100) having a switchback apparatus according to an embodiment of the invention.

The stamping apparatus 100 has a supply unit 101, a mechanical detector 102, an OCR scanner 103, a twist reversing unit 104, a switchback apparatus 105, a stamping unit 106, and a sorting/stacking unit 107, along a mail item M (sheet) conveying direction. The stamping apparatus 100 has a conveying unit 108 to convey a mail item M throughout the component units. The stamping apparatus 100 has a not-shown operation panel to give the apparatus instructions for changing operation modes and displaying errors.

The supply unit 101 accepts a large number of regular-size mail items M with fixed thickness and width along the direction orthogonal to a conveying direction (the length along the conveying direction may be different), takes out and supplies the mail items one by one to a processor in a later stage. The conveying unit 108 conveys the supplied mail item M through the processor 102-107 in a later stage.

The mechanical detector 102 detects metallic pieces, foreign matters and solid pieces contained in the mail item M conveyed by the conveying unit 108, detects double feeding (overlap) of mail item M and a short gap, and rejects a misfeed mail item M to a rejection unit 110 explained later in FIG. 3.

The mechanical detector 102 has a not-shown displace conveying unit, which displaces mail items M doubly fed by a pair of belts to hold and convey mail items M at different speeds in the same direction, and detects a double feeding by comparing the length of the mail item M fed to the displace conveying unit along the conveying direction, with the length of the mail item M fed out from the displace conveying unit.

The OCR scanner 103 optically reads the surface of mail item M, photoelectrically converts the read data, and obtains a sorting information such as a zip-code (post-code) and address written on a mail item M, as an image. The OCR scanner 103 detects the presence and position of a postage stamp (postal charge print) affixed to the mail item M. As the direction (front/back and top/bottom) of mail item M supplied through the supply unit 101 is different, the OCR scanner 103 has at least two scanners for reading both sides of mail item M.

The twist-reversing unit 104 has a not-shown twist reversing path to convey a mail item M by twisting 180° about a center axis extended along a mail item M conveying direction. Namely, the twist-reversing unit 104 reverses only the front/back sides of mail item M without changing the conveying direction. The twist-reversing unit 104 has a not-shown straight path for bypassing an input mail item M without feeding it to the twist-reversing path.

The switchback apparatus has two switchback mechanisms (explained in detail later) for reversing a mail item M conveying direction by accepting and outputting a mail item M to a reverse direction. The switchback apparatus has a straight path (a bypass conveying path, explained later) for bypassing two switchback mechanisms, like the twist-reversing unit 104. In this embodiment, the switchback apparatus having two switchback mechanisms is used. But, a switchback apparatus having three or more switchback mechanisms may be used.

The stamping unit 106 has a not-shown stamping hub to rotate by contacting one side of mail item M. The stamping unit 106 stamps a postmark by pressing the stamping hub onto a postage stamp. In this embodiment, all mail items M fed to the stamping unit 106 are adjusted in front/back and top/bottom as explained later, when passing through the twist-reversing unit 104 and switchback apparatus 105, and the stamping hub is provided only one side of the conveying path.

The sorting/stacking unit 107 sorts and stacks mail items M in a predetermined position according to the sorting information detected by the OCR scanner 103. Adjacent to the sorting/stacking unit 107, a rejection unit 109 (FIG. 3) is provided, which prohibits stamping by the stamping unit 106, and rejects a remaining mail item $M_r$ that is fed out after temporarily remaining in the switchback apparatus 105, as described later.

Figure 2:
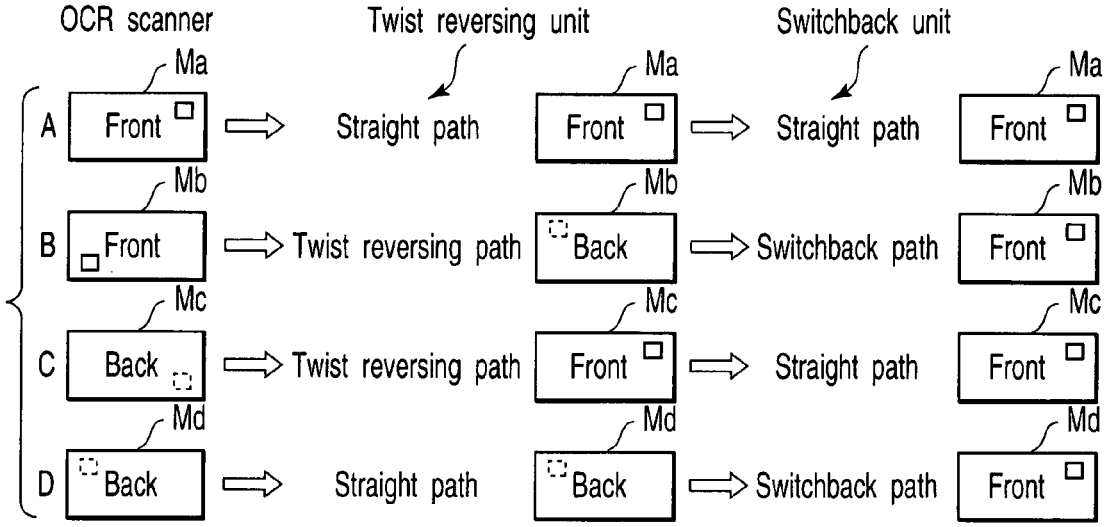
FIG. 2 shows an example of changing the posture of a mail item in the stamping apparatus of FIG. 1.

The twist-reversing unit 104 and switchback apparatus 105 function to adjust all mail items M supplied with unadjusted front/back and top/bottom, and feed them to the stamping unit 106 by adjusting front-back and top/bottom, as shown in FIG. 2.

For example, a mail item Ma detected as posture A in FIG. 2 by the OCR scanner 103 is conveyed along a straight path of the twist-reversing unit 104 and a straight path of the switchback apparatus 105, and fed to the stamping unit 106 in the same posture. A mail item Mb detected as posture B in FIG. 2 is conveyed along a twist-reversing path of the twist-reversing unit 104 and a switchback path of the switchback apparatus 105, and fed to the stamping unit 106 in the same posture as the mail item Ma. A mail item Mc detected as posture C in FIG. 2 is conveyed along a twist-reversing path of the twist-reversing unit 104 and a straight path of the switchback apparatus 105, and fed to the stamping unit 106 in the same posture as the mail item Ma. A mail item Md detected as posture D in FIG. 2 is conveyed along a straight path of the twist-reversing unit 104 and a switchback path of the switchback apparatus 105, and fed to the stamping unit 106 in the same posture as the mail item Ma. Namely, all mail items M passing through the twist-reversing unit 104 and switchback apparatus 105 are supplied to the stamping unit 106 in the same posture.

Figure 3:
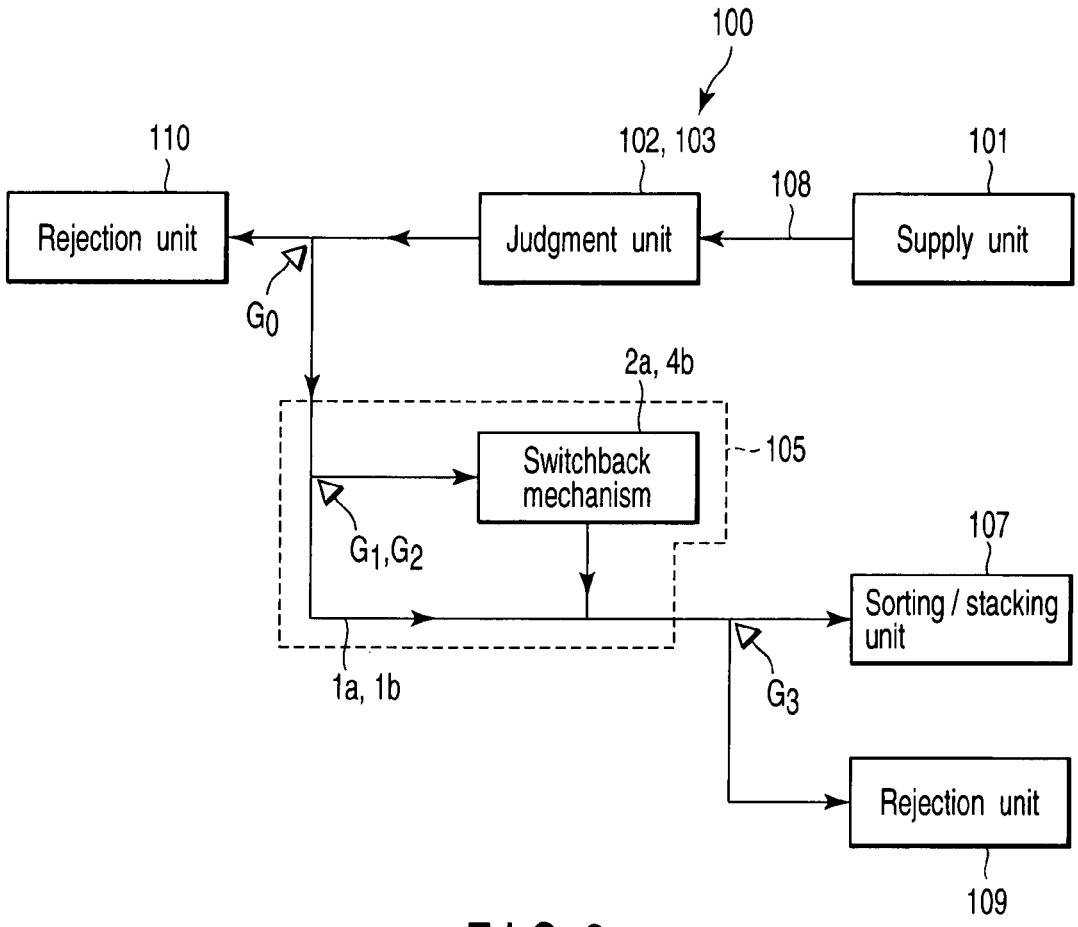
FIG. 3 is a block diagram showing primary components of the stamping apparatus of FIG. 1.

FIG. 3 is a perspective view of the primary components of the stamping apparatus 100.

Namely, a mail item M output from the supply unit 101 is conveyed by the conveying unit 108, and conveyed through the mechanical detector 102 and OCR scanner 103 (collectively called a judgment unit). A mail item M judged a reject mail item by the judgment unit (the mechanical detector 102) is rejected to the rejection unit 110 through a gate G0.

According to the sorting information of the mail item M read by the judgment unit (the OCR scanner 103), the mail item M is selectively switched back when passing through the switchback apparatus 105, and conveyed to and sorted/stacked in the sorting/stacking unit 107. At this time, a remaining mail item $M_r$ remaining temporarily in the switchback mechanisms 2*a* and 4*b* and then fed out is conveyed to the rejection unit 109 through a gate G3, and rejected.

The switchback apparatus 105 has two switchback mechanisms 2*a* and 4*b*, straight paths 1*a* and 1*b* to bypass these switchback mechanisms 2*a* and 4*b*, and two gates G1 and G2. Namely, a mail item M needed to be switched back is fed to the switchback mechanisms 2*a* and 4*b* through the gates G1 and G2. A mail item M not needed to be switched back is conveyed along the straight paths 1*a* and 1*b*.

Figure 4:
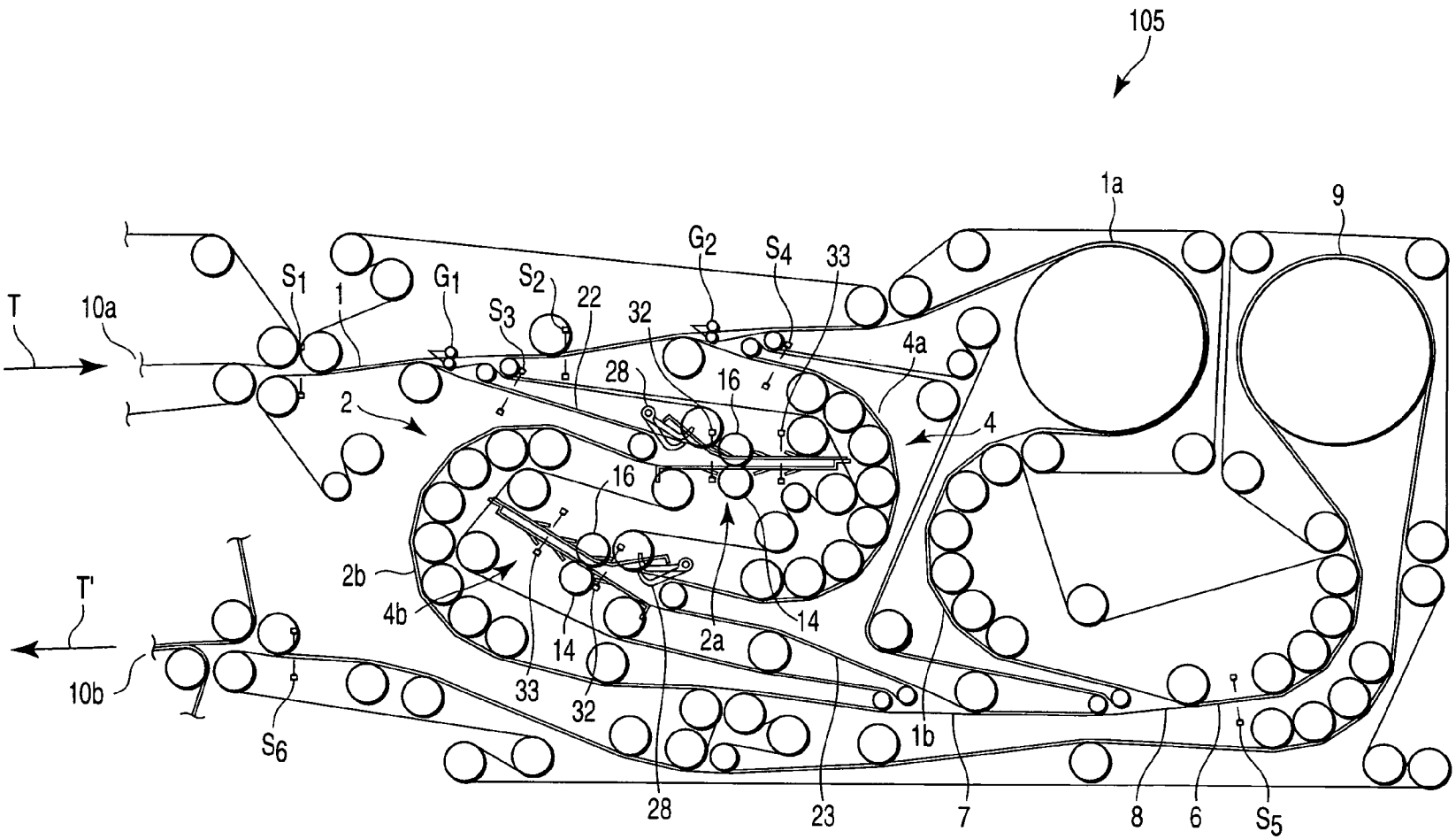
FIG. 4 is a plan view showing a basic structure of a switchback apparatus incorporated in the stamping apparatus of FIG. 1.

The structure of the switchback apparatus 105 will be explained in detail with reference to FIG. 4.

The switchback apparatus 105 has a main conveying path 1 to convey a mail item M in the direction of the arrow T. The OCR scanner 103 detects the postal stamp positions of all mail items M fed to the switchback apparatus 105 along the main conveying path 1. The twist-reversing unit 104 reverses the front/back of the mail item M fed to the switchback apparatus, if necessary.

In one side (the lower side in FIG. 4) of the main conveying path 1, a first processor 2 and a second processor 4 are provided adjacent to each other along the conveying direction T. On the main conveying path 1, switching gates G1 and G2 are provided to branch the mail item M conveyed along the main conveying path 1 into the first processor 2 and second processor 4.

The first processor 2 has a first switchback mechanism 2*a* which accepts the mail item M branched and conveyed along the main conveying path 1 through the gate G1, and takes out the mail item M in the verse direction, thereby reversing the mail item M conveying direction, and a fist U-turn path 2*b* which passes the mail item M switched back by the first switchback mechanism 2*a*. Namely, the mail item M branched and conveyed to the first processor 2 is switched back, and then conveyed in the reverse direction (U-turn). The mail item M passed through the first processor 2 and reversed in the conveying direction is conveyed in the direction of the arrow T', and fed to the stamping unit 106 along a rejection conveying path 6 below the first and second processors 2 and 4 in the lower part of the drawing and extended substantially parallel to the main conveying path 1.

The second processor 4 has a second U-turn path 4*a* which passes the mail item M branched and conveyed along the main conveying path 1 through the gate G2, and a second switchback mechanism 4*b* which accepts the mail item M conveyed along the second U-turn path 4*a*, feeds the mail item M in the reverse direction, thereby reversing the mail item M conveying direction. Namely, the mail item M branched and conveyed to the second processor 4 is conveyed in the reverse direction (U-turn), and then switched back. The mail item M passed through the second processor 4 and reversed in the conveying direction is led to the rejection conveying path 6 through a joining unit 7, and fed to the stamping unit 106.

The main conveying path 1 is connected to the rejection conveying path 6 by two gates G1 and G2 through a joining unit 8 in the downstream of the conveying direction. The main conveying path 1 in the upstream of the joining unit 8 functions as a bypass conveying path of the invention, and is curved by a drum roller 1*a* and U-turn path 1*b* (collectively called straight paths 1*a* and 1*b*). Therefore, the mail item M passing through the gate G1 and G2 and bypassing the first and second processors 2 and 4 is not reversed in front/back and top/bottom, and fed to the stamping unit 106 along the main conveying path 1 and rejection conveying path 6.

The lengths of the above-mentioned conveying paths and the processing time in the first and second switchback mechanisms 2*a* and 4*b* are designed, so that all mail items M fed to the switchback apparatus 105 along the main conveying path 1 are conveyed up to the joining unit 8 on the rejection conveying path 6 by the same time.

Figure 5:
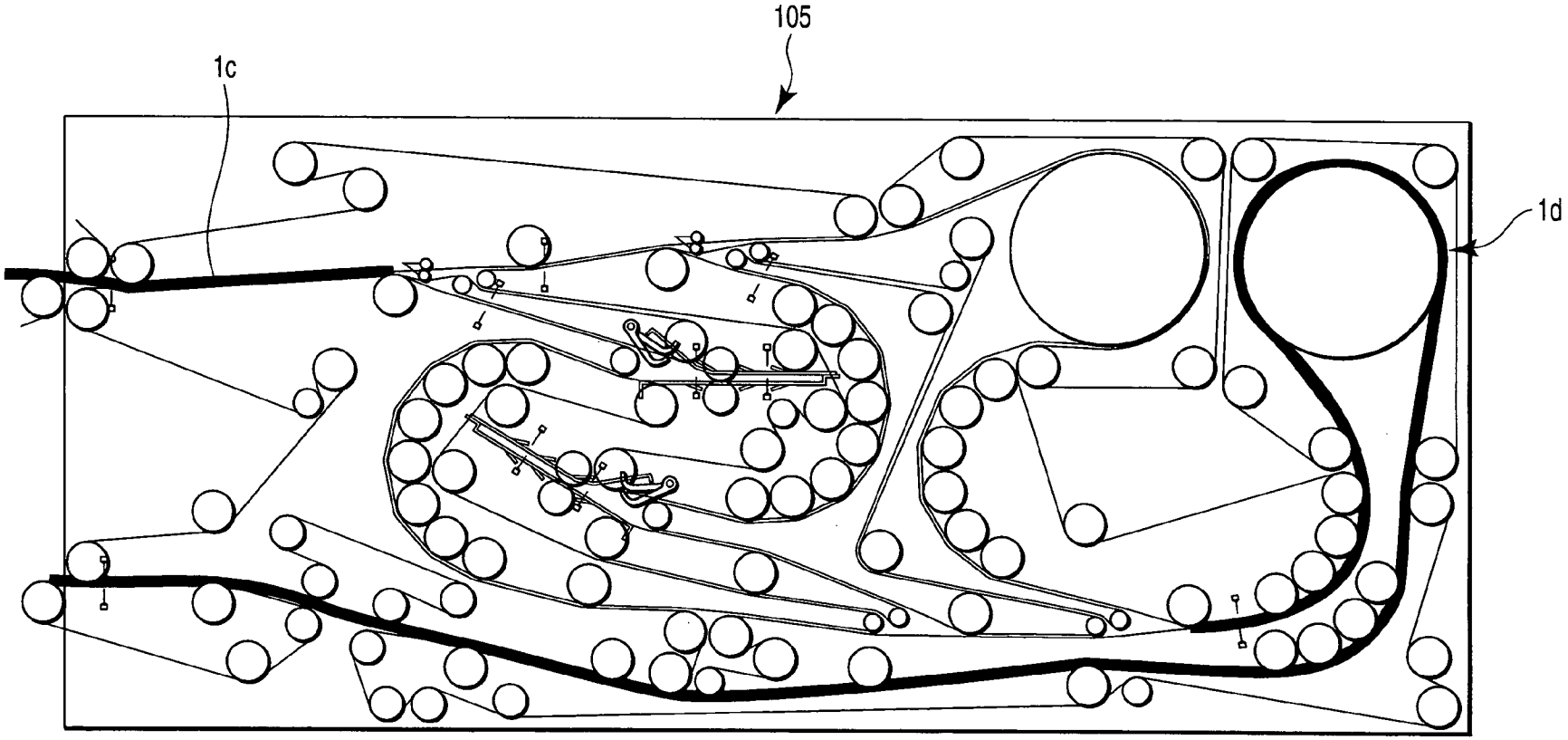
FIG. 5 is a view showing a main conveying path of the switchback apparatus of FIG. 4 indicated by a thick line.
Figure 6:
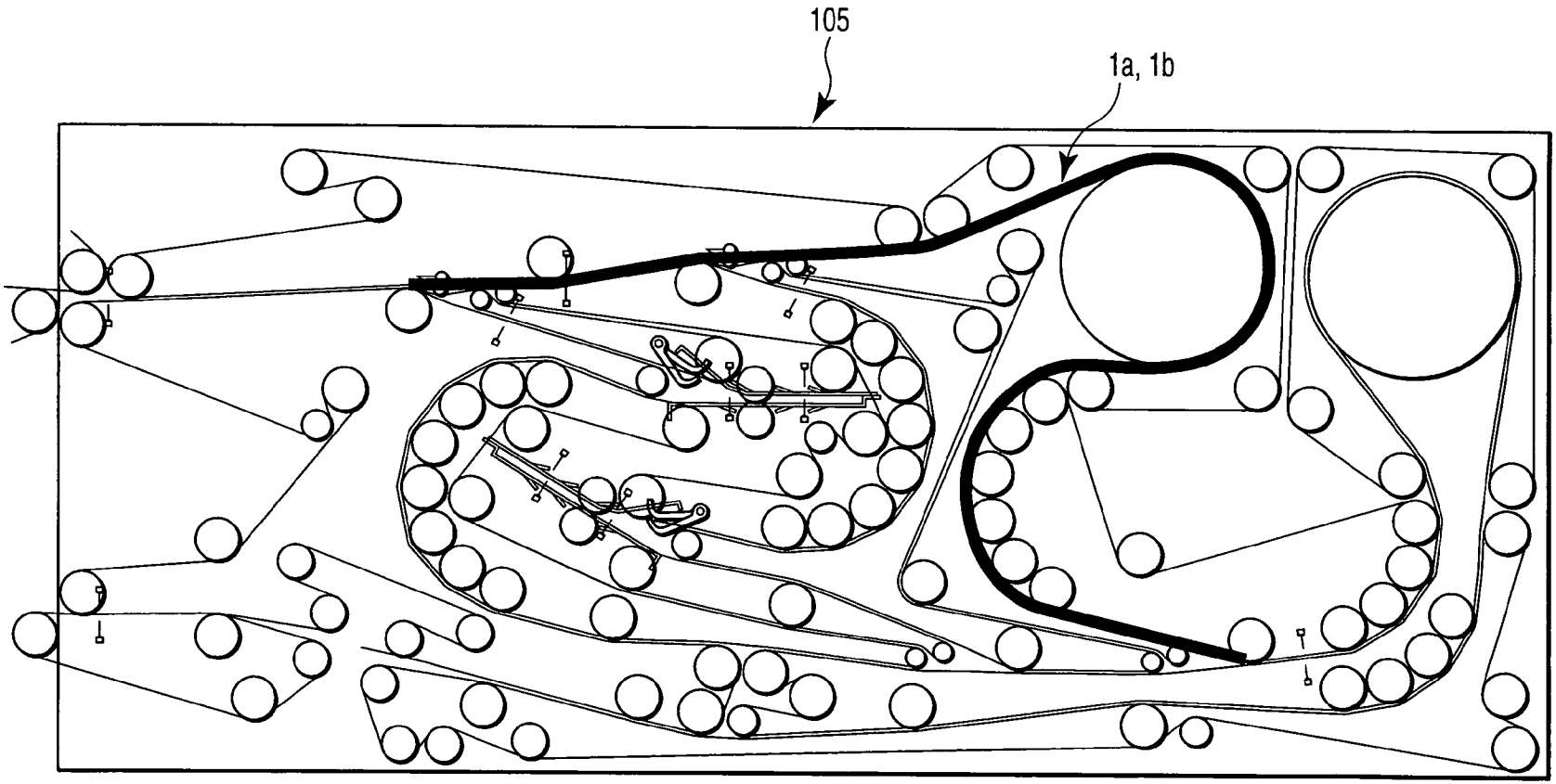
FIG. 6 is a view showing a straight path of the switchback apparatus of FIG. 4 indicated by a thick line.
Figure 7:
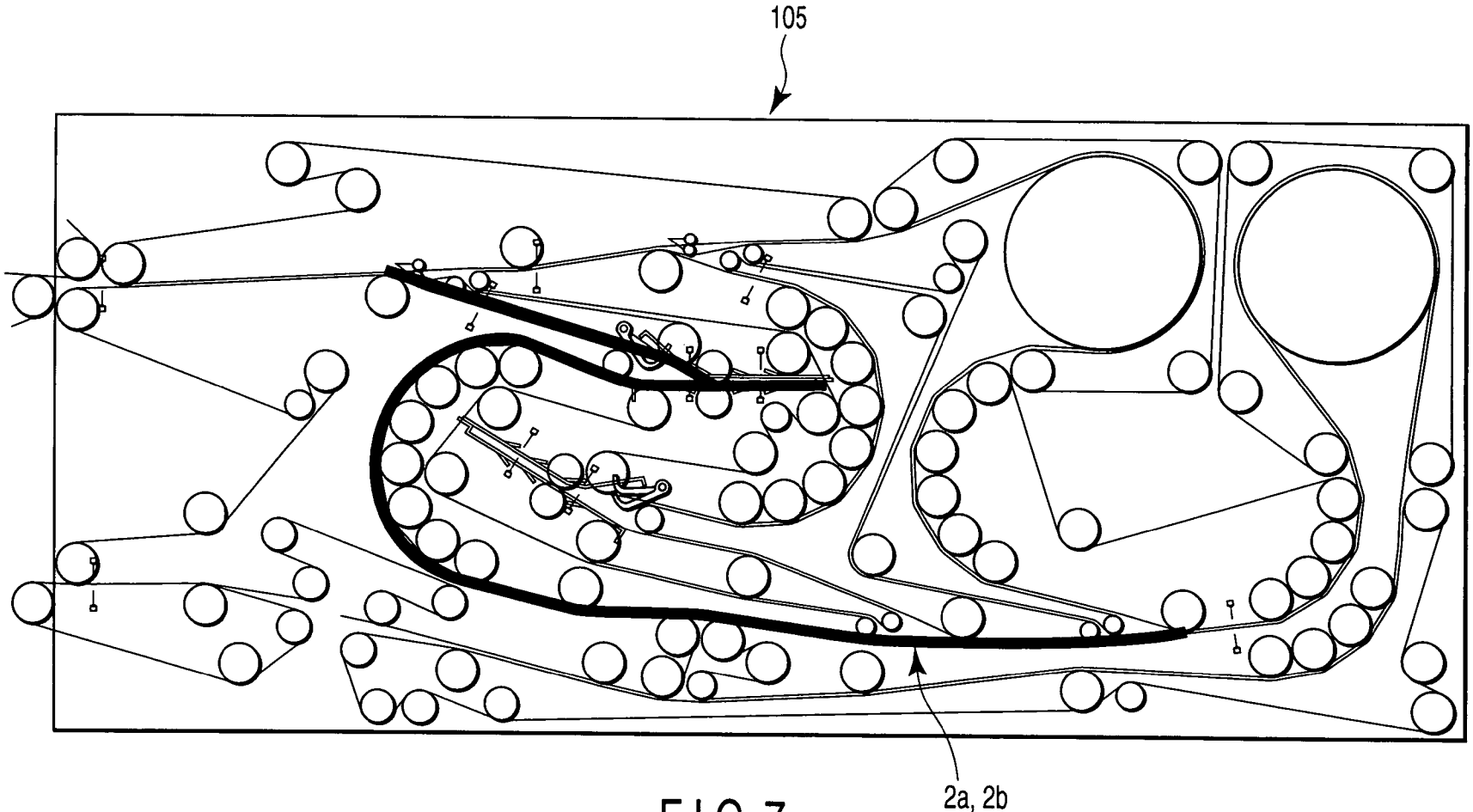
FIG. 7 is a view showing a first switchback conveying path of the switchback apparatus of FIG. 4 indicated by a thick line.
Figure 8:
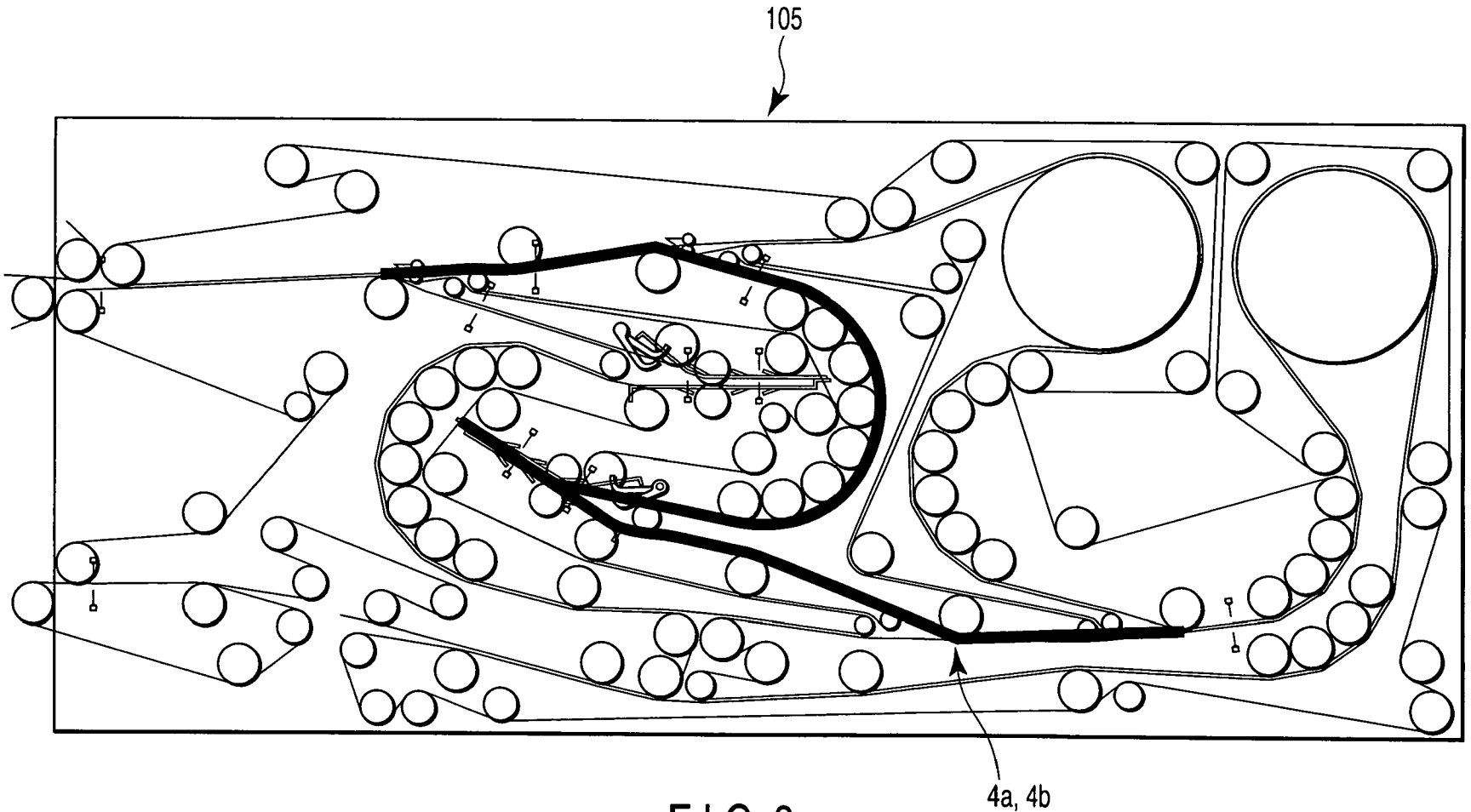
FIG. 8 is a view showing a second switchback conveying path of the switchback apparatus of FIG. 4 indicated by a thick line.

Namely, the lengths of the conveying paths 1*a*, 1*b*, 1*c*, 1*d*, 2*b* and 4*a*, the acceleration/deceleration speeds and stop time in the fist and second switchback mechanisms 2*a* and 4*b* are determined to make the processing time the same in any cases where the mail item M fed to the switchback apparatus 105 along the upstream main conveying path 1*c* indicated by a thick line in FIG. 5 is fed out from the switchback apparatus 105 along the downstream main conveying path 1*d* indicated by a thick line in FIG. 5, passing through the straight paths 1*a* and 1*b* indicated by a thick line in FIG. 6; the mail item M is passed through the switchback apparatus 105 along the main conveying path 1*c* in FIG. 5, first switchback conveying paths 2*a* and 2*b* indicated by a thick line in FIG. 7, and the main conveying path 1*d* in FIG. 5; and the mail item M is passed through the switchback apparatus 105 along the main conveying path 1*c* in FIG. 5, second switchback conveying paths 4*a* and 4*b* indicated by a thick line in FIG. 8, and the main conveying path 1*d* in FIG. 5.

In the switchback apparatus 105, the first switchback mechanism 2*a* of the first processor 2 is fit inside the second U-turn path 4*a* of the second processor 4, like a nest, and the second switchback mechanism 4*b* of the second processor 4 is fit inside the first U-turn path 2*b* of the first processor, like a nest. In other words, the first and second switchback mechanisms 2*a* and 4*b* are placed overlapping, and the first and second U-turn paths 2*b* and 4*a* are placed overlapping.

Namely, the mail item M is reversed in front and back after being switched back in one processor, and switched back after being reversed in front and back in the other processor. By adopting this structure, the sizes of the first and second processors 2 and 4 can be reduced in their placing directions, and the apparatus can be made compact. The apparatus size can be effectively reduced particularly by adopting the structure that a switchback mechanism of the other processor is fit inside the U-turn path of one processor, like a nest, as in the above-mentioned switchback apparatus 105.

In this embodiment, the rejection conveying path 6 is wound around the drum roller 9 and U-turned to the downstream of the joining unit 8, so that the mail item M supply position 10*a* and reject position 10*b* with respect to the switchback apparatus 105 are set to the left side of the switchback apparatus 105 in the drawing.

The switchback apparatus 105 has sensors for detecting a passage of mail item M on each conveying path. Namely, a sensor S1 is placed on the main conveying path 1 in the upstream of the gate G1, a sensor S2 is placed on the main conveying path 1 between the gates G1 and G2, a sensor S3 is placed on the conveying path branched to the first processor 2 by the gate G1, a sensor S4 is placed on the conveying path branched to the second processor 4 by the gate G2, a sensor S5 is placed on the rejection conveying path 6, and a sensor S6 is placed close to the mail item M reject position 10*b*.

The switchback apparatus 105 has a control unit 120 to control the operation of the apparatus 105. The control unit 120 controls mechanisms explained later, based on the information one the conveying positions of mail item M in the switchback apparatus 105 obtained through the sensors S1-S6. For example, the control unit 120 controls two gates G1 and G2 in the switchback apparatus 105, so that a mail item M needed to be reversed in the conveying direction among mail items fed to the switchback apparatus 105 is alternately fed to and handled by two switchback mechanisms 2*a* and 4*b*.

The switchback mechanisms 2*a* and 4*b* will be explained in detail with reference to FIG. 9.

Figure 9:
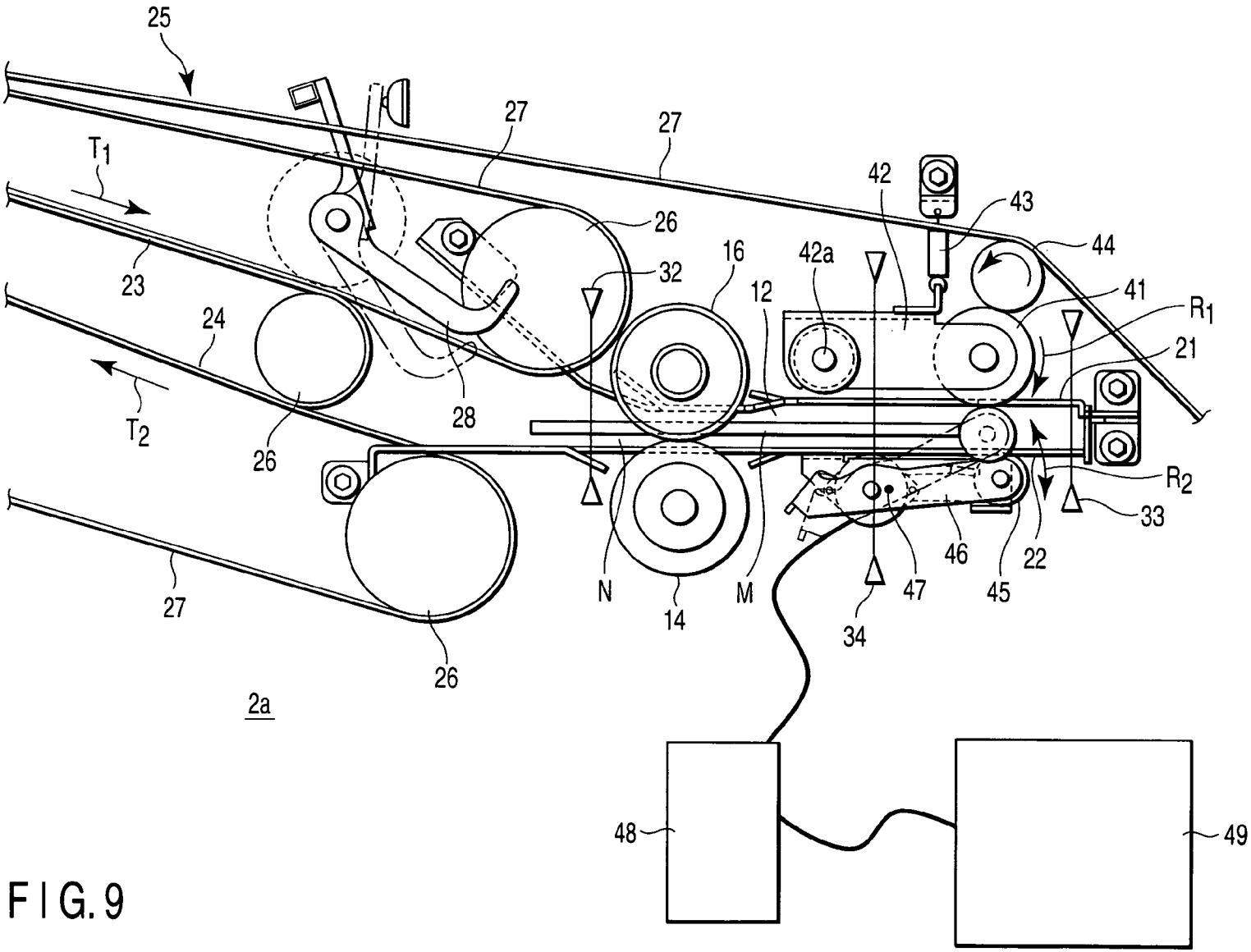
FIG. 9 is a schematic diagram of one switchback mechanism of the switchback apparatus of FIG. 4.

FIG. 9 is a plan view of the detailed structure of the first switchback mechanism 2*a*. The left and right sides are reversed in the second switchback mechanism 4*b*. The structure of the first switchback mechanism 2*a* will be explained, and explanation on the structure of the second switchback mechanism 4*b* will be omitted.

The first switchback mechanism 2*a* (hereinafter called a switchback mechanism 2*a*) has a driver roller 14 rotated in forward and backward directions by a motor 123, and a follower roller 16 pressed to contact the driver roller 14. These two rollers 14 and 16 are used as a switchback roller of the present invention, and placed to have a nip N therebetween involved in the switchback unit 12. The switchback mechanism 2*a* has a guide plate 21 defining one side of the switchback unit 12 (the upper side in the drawing), and a guide plate 22 defining the other side of the switchback unit 12 (the lower side in the drawing).

The switchback mechanism 2*a* has a take-in conveying path 23 to feed the mail item M in the direction of the arrow T1 in the drawing (a first direction) toward the nip N involved in the switchback unit 12, and an output conveying path 24 to feed the mail item M reversely from the nip N in the direction of the arrow T2 (a second direction).

Namely, the switchback mechanism 2*a* has a conveying mechanism 25, which conveys the mail item M along the take-in conveying path 23 in the direction of the arrow T1, and along the output conveying path 24 in the direction of the arrow T2. The conveying mechanism 25 has conveying rollers 26, endless conveying belts 27 wound and extended on the conveying rollers 26, and a motor 124 to rotate the conveying rollers 26.

A sensor 32 is provided in the upstream of the nip N along the direction of the arrow T1, and a sensor 33 is provided at the end of the switchback unit 12 along the direction of the arrow T1. A sensor 34 functioning as a remaining sheet sensor of the present invention is provided at about the mid point between the sensors 32 and 33. These three sensors 32, 33 and 34 are provided to detect existence of mail item M in the switchback mechanism 2*a*. Particularly, the central sensor 34 detects a remaining mail item $M_r$ that is deviated from the nip N and remaining in an area not having a tight-holding force in the switchback unit 12.

A remaining mail item $M_r$ mentioned here basically indicates a mail item remaining in the switchback unit 12 in the state not held by the nip N between the rollers 14 and 16. But, even a mail item that is not completely deviated from the nip N is regarded as a remaining mail item $M_r$ if it is not rejected from the switchback unit 12 by the rotation of the switchback rollers 14 and 16. A remaining mail item M mentioned in claims means the same state.

An output roller 41 is provided on the backside of the guide pate 21, or the side separated from the switchback unit 12. The output roller 41 is rotatably fixed to the end of an arm 42 provided rotatably about a rotation axis 42*a* fixed to a not-shown housing of the switchback unit 2*a*.

At a mid position of the arm 42, the other end of a tensile spring 43 whose one end is fixed to the housing is connected, and the output roller 41 is pressed to a drive transmission roller 44 wound with a conveying belt 27. A part of the output roller 41 separated from the drive transmission roller 44 is involved in the switchback unit 12 in the state exposed slightly through a not-shown opening of the guide plate 21.

The output roller 41 is given a driving force from the conveying belt 27 through the drive transmission roller 44, and rotated in the clockwise direction in the drawing (in the direction of the arrow R1), or in the direction of outputting the remaining mail item $M_r$ from the switchback unit 12 in the direction of the arrow T2. Namely, the conveying mechanism 25 functions as a driving mechanism in this embodiment. The output roller 41 of this embodiment is always given a driving force from the conveying belt 27 through the drive transmission roller 44 and always rotated, but as it is placed at a position not interfering with a mail item M when the mail item M is switched back, it does not have an influence on the switchback operation.

A pressure roller 45 is provided on the backside of the guide plate 22, or the side separated from the switchback unit 12. The pressure roller 45 is rotatably fixed to the distal end of a swing arm 46. A solenoid 47 (a moving mechanism) is fixed to a rotation axis 46*a* fixed close to the proximal end of the arm 46. The pressure roller 45 is placed at a position deviated from the switchback unit 12, or a retreat position on the backside of the guide plate 22, in the state moved to the retreat position indicated by a solid line in the drawing.

Therefore, when the solenoid 47 is driven and the arm 46 is swung from the retreat position indicated by a solid line in the drawing to the operating position indicated by a broken line, the pressure roller 45 fixed rotatably to the distal end of the arm 46 is moved to the operating position indicated by a broken line and pressed to the output roller 41 waiting in one side of the switchback unit 12.

Namely, when there is a remaining mail item $M_r$ remaining in the switchback unit 12, the remaining mail item M is caught and restrained between the output roller 41 and pressure roller 45 by energizing the solenoid 47, and the remaining mail item $M_r$ is output toward the nip N of the switchback rollers 14 and 16 by the rotation of the output roller 41 (always rotating).

The solenoid 47 is connected to a driver 48 to drive the solenoid 47. The driver 48 is connected to a controller 49. The controller 49 gets information about the positions of all sheets under convening from not-shown shift sensors placed on a not-shown conveying path of a stamping apparatus 100, particularly sensors S1-S6 provided in the switchback apparatus 105, determines an appropriate driving timing of the solenoid 47, and gives the driver 48 a driving command. The controller 49 is also connected to a driver 125 for driving a motor 123 to rotate the driver roller 14, one of the switchback rollers, in both forward and backward directions, and controls the rotation and driving of the switchback rollers 14 and 16.

Figure 10:
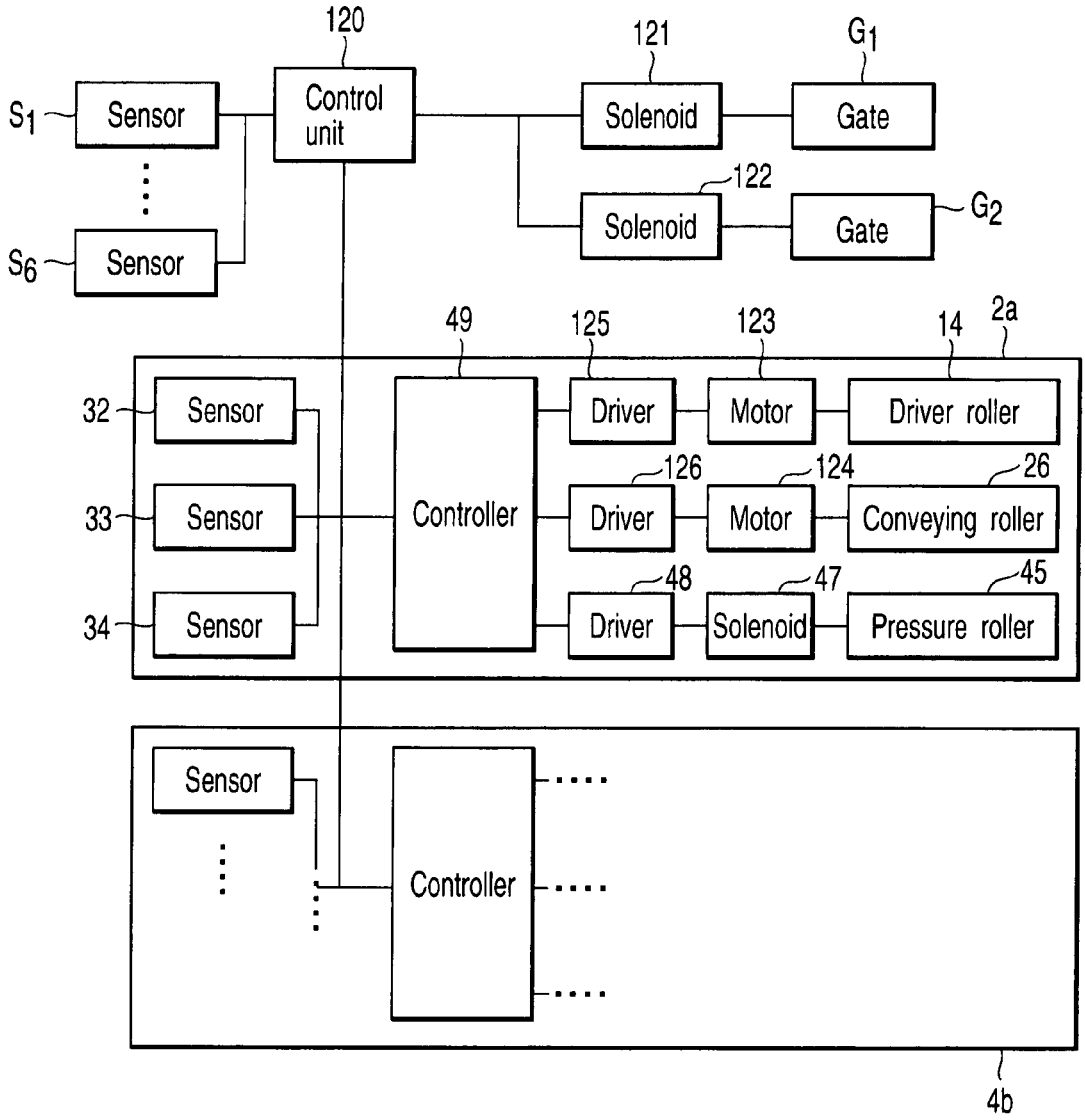
FIG. 10 is a block diagram of a control system to control the operation of a switchback apparatus including the switchback mechanism of FIG. 9.

FIG. 10 is a block diagram of a control system to control the operation of the switchback apparatus 105.

The control unit 120 to control the operation of the switchback apparatus 105 is connected to six sensors S1-S6. The control unit 120 is also connected to three sensors 32, 33 and 34 of the first switchback mechanism 2*a* of the first processor. The configuration of a control system of the second switchback mechanism 4*b* is similar to that of the first switchback mechanism 2*a*. A detailed explanation on the configuration of the control system of the second switchback mechanism 4*b* will be omitted.

The control unit 120 is also connected to a solenoid 121 to drive the gate G1 that connects the main conveying path to the first processor 2, and a solenoid 122 to drive the gate G2 that connects the main conveying path 1 to the second processor 4.

The control unit 120 is connected to a controller 49, which controls the operation of each part of the switchback mechanism 2*a*. The controller 49 is connected to three drivers 125, 126 and 48. The driver 125 is connected to the motor 123 to rotate the driver roller 14 in both forward and backward directions. The driver 126 is connected to the motor 124 to rotate the conveying roller 26 of the conveying mechanism 25. The driver 48 is connected to the solenoid 47 to drive the pressure roller 45.

Figure 11:
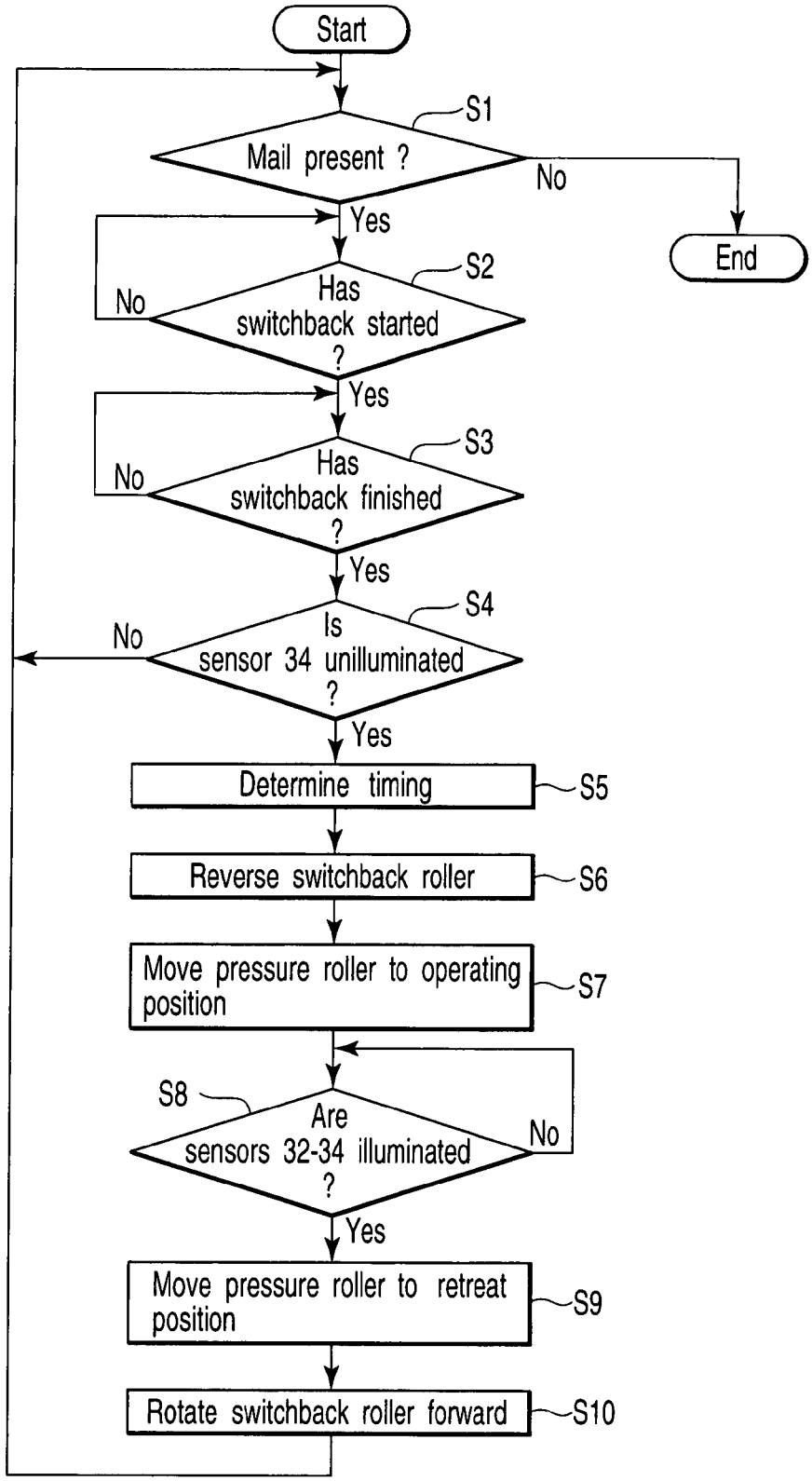
FIG. 11 is a flowchart for explaining the operation of the switchback mechanism of FIG. 9.

Next, an explanation will be given on the processing operation in the switchback mechanism 2*a* (4*b*) having the above-mentioned structure by referring to FIG. 9 and the flowchart shown in FIG. 11.

When a mail item M is conveyed in the direction of the arrow T1 by the conveying mechanism 25 along the take-in conveying path 23 (step 1: YES), the sensor 32 detects that the mail item M is input to the switchback unit 12, and the mail item M is started to switche back operation (step 2: YES).

At this time, the driver roller 14 rotates clockwise, and the follower roller 16 contacting the driver roller 14 rotates in the same direction of the driver roller 14. The forward end of the mail item M input to the switchback unit 12 enters the nip N between the driver roller 14 and follower roller 16, and the mail item M is held by the nip N and fed to the switchback unit 12.

Thereafter, the control unit 120 of the switchback apparatus 105 monitors the outputs of the sensors 32-34, and judges whether the switchback operation for the mail item M is finished (step 3). The finish of switchback mentioned here basically means the state that the mail item M fed to the switchback unit 12 is normally processed, reversed in its conveying direction, passed through the nip, and completely output from the switchback unit 12 in the reverse direction. However, if a mail item M is in the state to be certainly fed out from the switchback unit 12, even a mail item M whose rear end is held by the nip N can be regarded as the finish of switchback.

The finish of switchback mentioned in claims indicates the state that a mail item M is assumed to have been subjected to a normal switchback operation and switched back, and includes a mail item M is not switched back and remaining in the switchback unit 12.

In the switchback operation, after a mail item M enters the nip N, the driver roller 14 is decelerated at a predetermined timing, and the mail item M is stopped. The predetermined timing is the timing that the rear end of a mail item M does not completely quit the nip N when the mail item M is stopped, and the timing that this rear end can be directed to the output conveying path 24.

After the mail item M is stopped, a kick lever 28 is rotated from the position indicated by a solid line to the position indicated by a broken line in the drawing by a not-shown driving mechanism, and taps at the left end of the stopped mail item M. Then, the kick lever 28 is returned to the home position indicated by a solid line. The left end of the mail item M is directed to the output conveying path 24 in the lower side, and prepared for the reversing operation.

Then, the driver roller 14 is accelerated in the reverse direction, the mail item M held by the nip N and stopped is accelerated in the direction of the arrow T2, transferred to the conveying mechanism 25, and fed out along the output conveying path 24. The mail item M is switched back, and its conveying direction is reversed.

At this time, the control unit 120 judges that the switchback of the mail item M is finished, basically based on the output of the sensor 32 having changed from corresponding to the unilluminated state to corresponding to the illuminated state (step 3: YES). Namely, the finish of the switchback operation is judged by the fact that the mail item M is switched back and rejected without deviating from the optical axis of the sensor 32 (in the state that the mail item M is being held by the nip N), after the sensor 32 turns dark and the mail item M is fed to the switchback unit 12. The finish of the switchback operation is judged otherwise by the fact that mail item M quits the tight-holding by the nip N and remains in the switchback unit 12, after the mail item M is fed to the switchback unit 12.

After the switchback operation is finished in step 3, the control unit 120 detects existence of remaining mail item $M_r$ (remaining sheet) in the switchback unit 12 through the sensor 34 placed at substantially the mid position of the switchback unit 12 (step 4). When the output of the sensor 34 corresponds to the illuminated state and no remaining mail item $M_r$ exists (step 4: NO), the control unit 120 judges that the mail item M has been normally processed, and returns to step 1 to prepare for the next mail item M.

If any remaining mail item $M_r$ is detected in the switchback unit 12 (step 4: YES), the control unit 120 determines the timing to output the remaining mail item $M_r$ from the switchback unit 12 (step 5). At this time, the control unit 120 gets the timing for conveying other mail items M conveying in the switchback apparatus 105 from the outputs of the sensors S1-S6, and finds the timing that the remaining mail item $M_r$ does not to interfere with the other mail items M.

For example, when outputting a remaining mail item $M_r$ from the switchback mechanism 2*a*, the control unit 120 determines the timing not to interfere with the other mail items M when the remaining mail item $M_r$ joins in the joining unit 8, based on the timing for conveying a mail item M under processing in the other switchback mechanism 4*b*, that is, a mail item M conveying along the second switchback conveying path 4*a*/4*b* indicated by a thick line in FIG. 8, a mail item M conveying along the bypass conveying path 1*a*/1*b* indicated by a thick line in FIG. 6, and a mail item M to be processed later.

Generally, the size and weight of mail item M processed in the stamping apparatus 100 is different. Thus, it is known that even if a mail item M is output with a predetermined gap in the supply unit 101, the intervals between the mail items M is changed on the way of conveying. A remaining mail item $M_r$ can be output to a position where the interval between the mail items M is expanded over a certain extent. A gap between mail items M to permit to interrupt a remaining mail item $M_r$ is an interval that can keep a gap between mail items M defined in the stamping apparatus 100 when inserting a remaining mail item $M_r$.

However, if it takes time to find the interval to output the remaining mail item $M_r$, the switchback mechanism 2*a* cannot be used at the time and the processing capacity is decreased. In such a case difficult to find a gap to output the remaining mail item $M_r$, the control unit 120 takes out the remaining mail item $M_r$ at the timing of overlapping the remaining mail item $M_r$ with a normally processed mail item M, assuming that the normally processed mail item M is rejected when preset time is up. In this case, the mail item M overlapped with the remaining mail item $M_r$ is also conveyed to the rejection unit 109.

Anyway, when the timing to output the remaining mail item $M_r$ is determined in step 5, the control unit 120 reverses the rotating direction of the driver roller 14 and controls the controller 49 to rotate the switchback rollers in the reverse direction at a predetermined speed (step 6). The control unit 120 controls the controller 49 at the timing determined in step 5, and drives the solenoid 47 to move the pressure roller 45 from the retreat position to the operating position (step 7).

The remaining mail item $M_r$ remaining in the switchback unit 12 is held and given a conveying force between the output roller 41 and the pressure roller 45 which are always rotating, and conveyed to the nip N between the switchback rollers 14 and 16. The remaining mail item $M_r$ fed to the nip N is conveyed in the direction of the arrow T2 by the switchback rollers 14 and 16, and output from the switchback unit 12.

At this time, the control unit 120 judges the remaining mail item $M_r$ output from the switchback unit 12 based on the outputs of all sensors 32-34 of the switchback mechanism 2*a* having changed to correspond to the illuminated state (step 8: YES), and controls the controller 49 to give a command to the driver 48 to drive the solenoid 47, and moves the pressure roller 45 from the operating position to the retreat position (step 9). This prevents the next mail item M fed to the switchback 12 from being interfered by the pressure roller 45. At the same time, the control unit 120 rotates the driver roller 14 forward, that is, in the direction of taking the mail item M into the switchback unit 12 (step 10), and waits for the next mail item M.

As explained above, according to the switchback mechanisms 2*a* and 4*b* of this embodiment and the switchback apparatus 105 provided with these switchback mechanisms, after a mail item M is switched back by the switchback mechanism 2*a* (4*b*), whether a remaining mail item $M_r$ exists in the switchback unit 12 is judged, and if any remaining mail item $M_r$ exists in the switchback unit 12, the remaining mail item $M_r$ is automatically output from the switchback unit 12 at an appropriate timing. Therefore, even if a remaining mail item $M_r$ exists in the switchback unit 12, it is unnecessary to stop the stamping apparatus 100 to output the remaining mail item $M_r$. This can greatly reduce the time to stop the apparatus for clearing a paper jam, and increase the throughput of the apparatus.

According to this embodiment, as a remaining mail item $M_r$ remaining in the switchback unit 12 is automatically and forcibly output from the switchback unit 12, a mail item M fed to the switchback unit 12 does not abut a remaining mail item $M_r$ causing a paper jam, and a remaining mail item $M_r$ is not output together with a mail item M normally switched back. This can greatly reduce the number of stops for clearing a paper jam, and greatly increase the throughput the apparatus.

Though a remaining mail item $M_r$ is output from the switchback unit 12 at an appropriate timing in this embodiment, if it takes time to find a space to output a remaining mail item $M_r$, the processing capacity of the switchback apparatus 105 is lowered. In such a case, a remaining mail item $M_r$ is output at the timing of overlapping the remaining mail item $M_r$ with a normally processed mail item M by trading off the mail item M, and the overlapped two mail items M and $M_r$ are conveyed to the rejection unit. Namely, according to this embodiment, even if it is difficult to find a gap large enough to output a remaining mail item $M_r$, a remaining mail item $M_r$ can be forcibly output from the switchback unit 12, and the processing capacity of the whole switchback apparatus 105 is not decreased.

Figure 12:
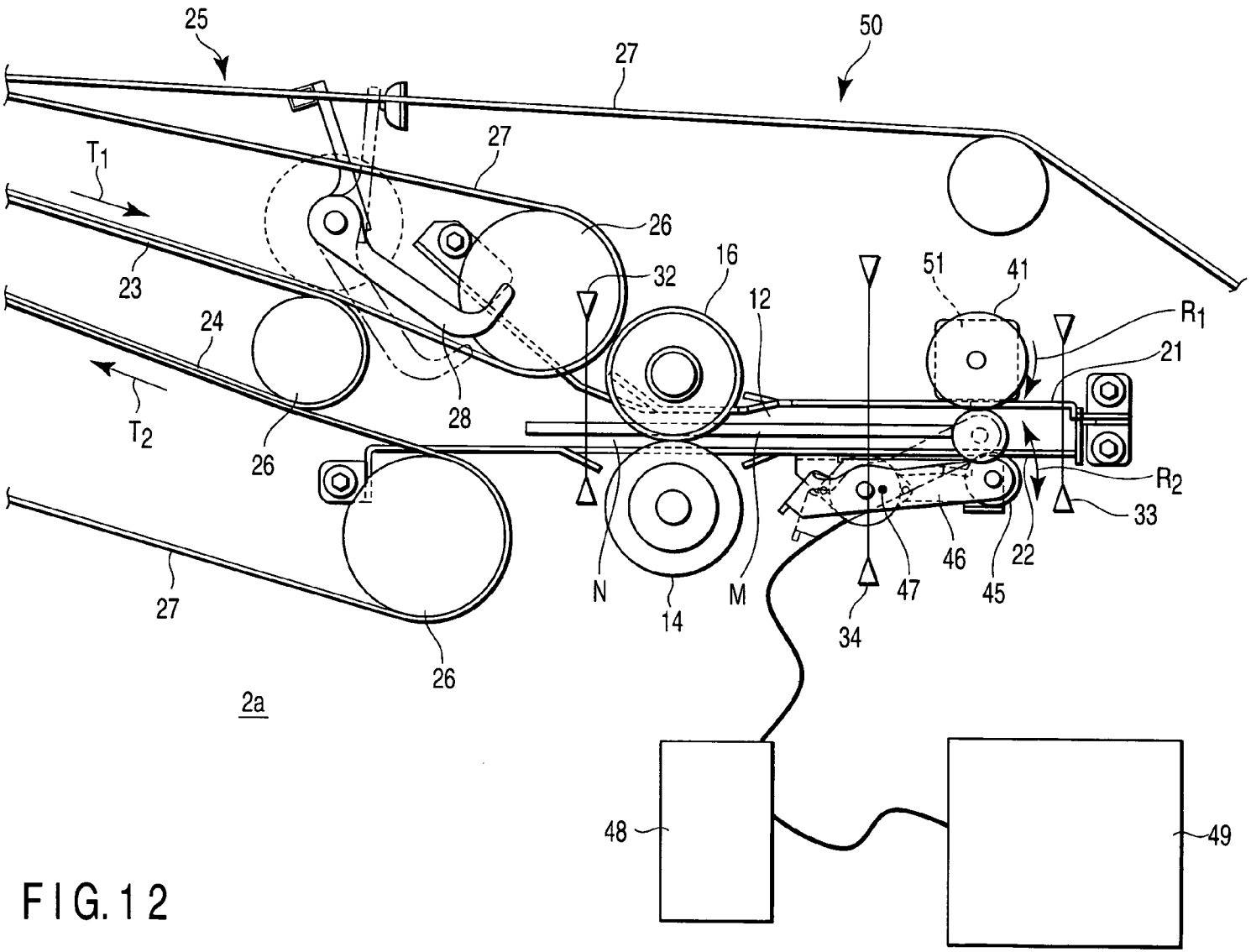
FIG. 12 is a plan view of a switchback mechanism according to another embodiment of the invention.

FIG. 12 is a plan view of a switchback mechanism 50 according to another embodiment of the invention. The switchback mechanism 50 has the same structure as the switchback mechanism 2*a* (4*a*), except a motor 51 fixed to the rotation axis of the output roller 41 instead of the components 42, 43 and 44 to transmit a driving force from the conveying belt 27 to the output roller 41 of an output mechanism. The same components having the same functions as in the aforementioned embodiment are given the same reference numerals, and not explained in detail.

As a driving force is not transmitted from the conveying belt 27 to the switchback mechanism 50 having an output mechanism unlike the aforementioned embodiment, when operating the switchback mechanism 50, it is necessary to rotate the motor 51 at an appropriate timing and rotate the output roller 41 in the direction of the arrow R1 in the drawing. Concretely, when reversing the rotation of the driver roller 14 as one of the switchback rollers in step 6 in the flowchart of FIG. 11, it is necessary to energize the motor 51 and rotate the output roller 41 in the direction of the arrow R1. The other operations are the same as those explained in the flowchart of FIG. 11.

By using the switchback mechanism 50 of this embodiment, the same effect as the aforementioned embodiment can be obtained, and the net working rate of the apparatus can be increased.

Figure 13:
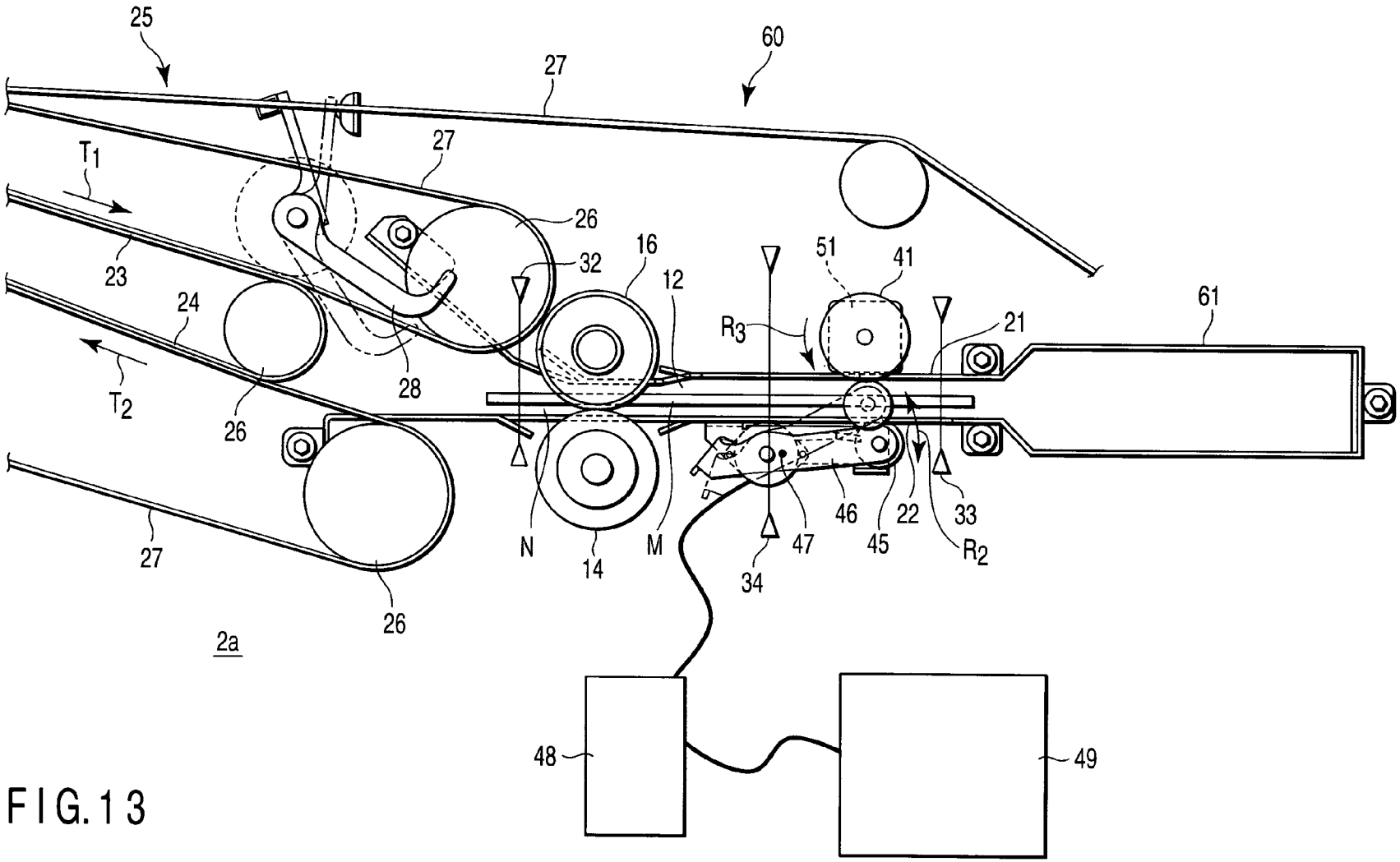
FIG. 13 is a plan view of a modification of the switchback mechanism of FIG. 12.
Figure 14:
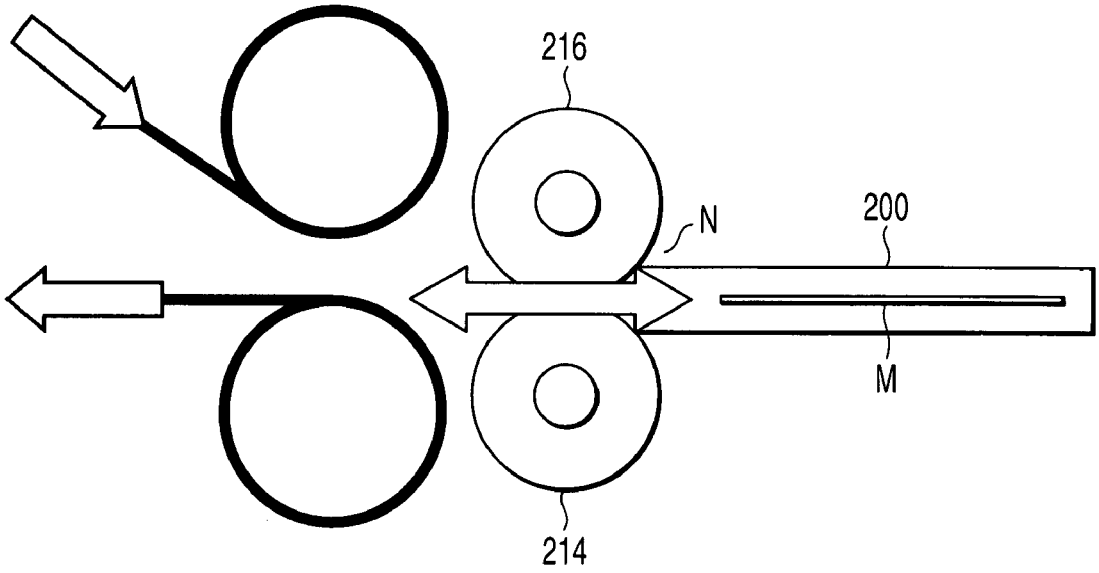
PRIOR ART FIG. 14
FIG. 14 is a perspective view of an example of a conventional switchback mechanism.

FIG. 13 shows a modification 60 of the switchback mechanism 50. This switchback mechanism 60 has the same structure as the switchback mechanism 50, except a rejection unit 61 provided on the right side of the switchback unit 12 in the drawing, that is, in the downstream of the switchback unit 12 along the direction of the arrow T1. The same components having the same functions as in the switchback mechanism 50 are given the same reference numerals, and not explained in detail.

When operating the switchback mechanism 60, it is possible to operate in the same way as operating the switchback mechanisms 2*a*, 4*b* and 50. The switchback mechanism 60 can output a remaining mail item $M_r$ remaining in the switchback unit 12 by taking it further in the direction of inputting a mail item M, that is, in the direction of the arrow T1.

Namely, if there is a large possibility of causing trouble such as a misfeed and paper jam when feeding a remaining mail item $M_r$ in the direction of the arrow T2 as in the stamping apparatus 100, like in each of the above embodiments, the operation of outputting a remaining mail item $M_r$ to the rejection unit 61 at the time of detecting the remaining mail item $M_r$. In this case, previously rotate the motor 51 in the reverse direction (in the direction of R3 in the drawing), operate the output mechanism at an optional timing immediately after occurrence of remain, move the pressure roller 45 to the operating position, and feed out a remaining mail item $M_r$ to the rejection unit 61 in the direction of the arrow T1.

By using the switchback mechanism 60, the same effect as the aforementioned embodiment can be obtained, a remaining mail item $M_r$ can be output from the switchback unit 12 more certainly at an optional timing of rejection, and the necessity of clearing a paper jam in the switchback unit 12 can be almost eliminated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, in the above embodiments, the pressure roller 45 is rotated to follow the output roller 41 by rotating the output roller 41 of the switchback mechanisms 2*a*, 4*b*, 50 and 60. But, the output roller 41 may be rotated to follow the pressure roller 45. A belt may be used instead of a roller.

What is claimed is:

1. A switchback mechanism comprising:

a switchback roller which accepts in a nip a paper sheet conveyed in a first direction toward a switchback unit, rotates in the first direction, stops the paper sheet in the switchback unit while holding the paper sheet in the nip, rotates in a second direction reverse to the first direction, reverses the paper sheet conveying direction, and takes out the paper sheet from the switchback unit to the second direction;

a remaining paper sheet sensor which detects a remaining paper sheet deviated from the nip in the downstream of the nip along the first direction and remaining in the switchback unit;

an output mechanism which is positioned in the downstream of the nip along the first direction and outputs the remaining paper sheet from the switchback unit; and a control unit which takes out the remaining paper sheet from the switchback unit by operating the output mechanism, when the remaining paper sheet is detected through the remaining paper sheet sensor, after the switchback roller finishes the switchback operation, wherein the output mechanism includes:

an output roller provided rotatably in the second direction one side of the remaining paper sheet;

a pressure roller provided movably between an operating position to hold the remaining paper sheet by cooperating with the output roller and a retreat position separated from the output roller, and provided rotatably in the second direction;

a moving mechanism configured to move the pressure roller between the operating position and retreat position; and a driving mechanism configured to rotate at least one of the output roller and pressure roller in the second direction.

2. The switchback mechanism according to claim 1, wherein the control unit rotates the switchback roller in the second direction, when outputting the remaining paper sheet; and the output mechanism outputs the remaining paper sheet in the second direction toward the nip.

3. The switchback mechanism according to claim 2, wherein the control unit obtains timing of conveying other paper sheets, and takes out the remaining paper sheet at timing not to interfere with the other paper sheets, when operating the output mechanism for outputting the remaining paper sheet in the second direction.

4. The switchback mechanism according to claim 2, wherein the control unit obtains timing of conveying other paper sheets, and takes out the remaining paper sheet at timing of overlapping the remaining paper sheet with one of the other paper sheets, when operating the output mechanism for outputting the remaining paper sheet in the second direction, and conveys the overlapped paper sheets to a rejection unit.

5. The switchback mechanism according to claim 1, wherein the output roller is placed partially exposed in the switchback unit so as not to interfere with a paper sheet being switched back by the switchback roller, and the pressure roller is retreated to the outside of the switchback unit when the pressure roller is moved to the retreat position by the moving mechanism.

* * * * *